US006020275A

United States Patent [19]

Stevenson et al.

[11] Patent Number: 6,020,275

[45] Date of Patent: Feb. 1, 2000

[54] BONDED COMPOSITE OPEN MESH STRUCTURAL TEXTILES

[75] Inventors: Peter Edward Stevenson, Easley, S.C.; Jeffrey W. Bruner, Greensboro, N.C.

[73] Assignee: The Tensar Corporation, Atlanta, Ga.

[21] Appl. No.: 08/643,182

[22] Filed: May 9, 1996

Related U.S. Application Data

[63] Continuation-in-part of application No. 08/440,130, May 12, 1995, abandoned.

[51] Int. Cl.[7] ..... B32B 5/08

[52] U.S. Cl. ..... 442/60; 442/189; 442/199; 442/203; 442/217; 442/220

[58] Field of Search ..... 442/4, 43, 49, 442/60, 189, 203, 217, 218, 220, 199

[56] References Cited

U.S. PATENT DOCUMENTS

| | | | |
|---|---|---|---|
| 3,481,371 | 12/1969 | Row | 139/383 R |
| 3,517,514 | 6/1970 | Visser | 61/38 |
| 3,561,219 | 2/1971 | Nishizawa et al. | 61/38 |
| 3,928,696 | 12/1975 | Wandel et al. | 428/102 |
| 3,998,988 | 12/1976 | Shimomai et al. | 428/400 |
| 4,107,371 | 8/1978 | Dean | 428/255 |
| 4,116,743 | 9/1978 | Davis | 156/333 |
| 4,144,371 | 3/1979 | Okie et al. | 428/255 |
| 4,259,394 | 3/1981 | Khan | 428/229 |
| 4,374,798 | 2/1983 | Mercer | 264/288.8 |
| 4,388,364 | 6/1983 | Sanders | 428/253 |
| 4,421,439 | 12/1983 | ter Burg et al. | 405/258 |
| 4,428,698 | 1/1984 | Murphy et al. | 404/17 |
| 4,434,200 | 2/1984 | Fash et al. | 428/257 |
| 4,469,739 | 9/1984 | Gretzinger et al. | 428/198 |
| 4,472,086 | 9/1984 | Leach | 405/258 |
| 4,489,125 | 12/1984 | Gagnon | 428/235 |
| 4,497,863 | 2/1985 | Cogan, Jr. | 428/253 |
| 4,521,131 | 6/1985 | Nandlal | 405/116 |
| 4,535,015 | 8/1985 | Bruner et al. | 428/44 |
| 4,540,311 | 9/1985 | Leach | 404/72 |
| 4,563,382 | 1/1986 | Viel | 428/198 |
| 4,608,290 | 8/1986 | Schnegg | 428/101 |

(List continued on next page.)

FOREIGN PATENT DOCUMENTS

| | | |
|---|---|---|
| 7127395 | 12/1985 | Taiwan . |
| 079444 | 7/1996 | Taiwan . |
| WO95/21965 | 8/1995 | WIPO . |

OTHER PUBLICATIONS

Tai Chia–pin et al, "Construction and Materials", T'ienyu Press, Taipei City, Jun. 15, 1992, pp. 10–20 to 10–25 (w/trans).

Nonwovens Markets, vol. II, No. 14, Jul. 22, 1996, p. 2.

Strata Grid 500, Product Specifications (including product sample), Strata Systems, Inc., Alpharetta, Georgia Rehau–Armapal 5030 (including product sample) No Date.

(List continued on next page.)

*Primary Examiner*—Deborah Jones
*Assistant Examiner*—Jason Savage
*Attorney, Agent, or Firm*—Jacobson, Price, Holman & Stern, PLLC

[57] ABSTRACT

Bonded composite open mesh structural textiles are formed of woven textile. The textile is formed from at least two, and preferably three, components. The first component, or load bearing member, is a high tenacity, high modulus, low elongation mono- or multifilament yarn. The second component is a polymer in yarn or other form which will encapsulate and bond yarns at the junctions to strengthen the junctions. The third component is an optional effect or bulking yarn. In the woven textile, a plurality of warp yarns are woven with a plurality of weft (fill) yarns. The weave preferably includes a half-cross or full-cross leno weave. At least a portion of the warp and weft yarns are first component load bearing yarns. The polymer component is used as required for the bonding properties necessary for the finished product, and especially to provide improved junction or joint strength. The effect or bulking yarns are used as warp and/or weft yarns and/or leno yarns as required to provide the desired bulk in the textile and relatively thick profile for the finished product.

21 Claims, 9 Drawing Sheets

U.S. PATENT DOCUMENTS

| | | | |
|---|---|---|---|
| 4,610,568 | 9/1986 | Koerner | 405/19 |
| 4,623,281 | 11/1986 | Verbauwhede et al. | 405/19 |
| 4,636,428 | 1/1987 | Bruner et al. | 428/254 |
| 4,643,119 | 2/1987 | Langston et al. | 112/421 |
| 4,724,179 | 2/1988 | Schnegg | 428/101 |
| 4,837,387 | 6/1989 | van de Pol | 428/229 |
| 4,840,832 | 6/1989 | Weinle et al. | 428/156 |
| 4,841,749 | 6/1989 | Patracek et al. | 66/190 |
| 4,844,969 | 7/1989 | Chang | 5/186 R |
| 4,845,963 | 7/1989 | Parekh | 66/170 |
| 4,960,349 | 10/1990 | Willibey et al. | 405/262 |
| 4,980,227 | 12/1990 | Sekiguchi et al. | 428/241 |
| 5,056,960 | 10/1991 | Marienfeld | 405/270 |
| 5,091,247 | 2/1992 | Willibey et al. | 428/255 |
| 5,100,713 | 3/1992 | Homma et al. | 139/383 R |
| 5,104,703 | 4/1992 | Rachman et al. | 428/35.6 |
| 5,137,393 | 8/1992 | Fuhr et al. | 405/129 |
| 5,156,495 | 10/1992 | Mercer | 405/262 |
| 5,158,821 | 10/1992 | Gebauer et al. | 428/174 |
| 5,167,765 | 12/1992 | Nielsen et al. | 162/146 |
| 5,187,004 | 2/1993 | Risseeuw | 428/229 |
| 5,191,777 | 3/1993 | Schnegg | 66/195 |
| 5,192,601 | 3/1993 | Neisler | 428/120 |
| 5,219,636 | 6/1993 | Golz | 428/193 |
| 5,258,217 | 11/1993 | Lewis | 428/120 |
| 5,403,126 | 4/1995 | Carriker et al. | 405/270 |
| 5,419,951 | 5/1995 | Golz | 428/229 |
| 5,436,064 | 7/1995 | Schnegg et al. | 428/234 |
| 5,600,974 | 2/1997 | Schnegg et al. | 66/192 |
| 5,669,796 | 9/1997 | Harford | 442/220 |

OTHER PUBLICATIONS

Published Information: FORTRAC, MATREX, MIRAGRID, ARMAPAL, RAUGRID and HaTelit, BTTG, Didsbury, Mancester, England MIRAGRID, Geogrids for Steep Slope Reinforcement, Nicolon Mirafi Group, Norcross, Georgia No Date.

Geogrid Product Data, Geotechnical Fabrics Reports, Dec. 1992, pp. 171–178.

Product Data: Strata Grid, Strata Systems, Inc., Oct. 31, 1994.

"Pull Out Tests and Junction Strengths of Geogrids", Geosynthetics World, Jun. 1991.

Shacklette, L.W., et al, "EMI Shielding Intrinsically Conductive Polymers", ANTEC '91, pp. 665–667 (No month).

Kulkarni, V.G., et al, "Thermal Stability of Polyaniline", Synthetic Metals, 30 (1989), pp. 321–325 (No month).

Leidersdorf, C.B., et al, "The Sand Mattress Method of Slope Protection", Arctic Offshore Engineering, pp. 723–731 No Date.

Kulkarni, V.G., et al, "Processible Intrinsically Conductive Polymer Blends", ANTEC '91, pp. 663–664 (No month).

BONDED COMPOSITE OPEN MESH STRUCTURAL TEXTILES

CROSS-REFERENCE TO RELATED APPLICATION

This application is a continuation-in-part of application Ser. No. 08/440,130, filed May 12, 1995, now abandoned.

BACKGROUND OF THE INVENTION

1. Field of the Invention

The present invention relates to bonded composite open mesh structural textiles primarily designed for use as structural load bearing elements in earthwork construction applications such as earth retention systems (in which the load bearing element is used to internally reinforce steeply inclined earth or construction fill materials to improve their structural stability), foundation improvement systems (in which the load bearing element is used to support and/or internally reinforce earth or foundation fill materials to improve their load bearing capacity), pavement improvement systems (in which the load bearing element is used to internally reinforce flexible pavements or to support rigid modular paving units to improve their structural performance and extend their useful service lives) or erosion protection systems (in which the load bearing element is used to confine or internally reinforce earth or construction fill materials in structures which are subject to erosion or which prevent erosion elsewhere by dissipating wave energy in open water). While the materials of this invention have many other diverse applications, they have been primarily designed to embody unique characteristics which are important in engineered earthwork construction and particular emphasis is placed on such uses throughout this application.

2. Description of the Prior Art

Geogrids and geotextiles are polymeric materials used as load bearing, separation or filtration elements in many earthwork construction applications. There are four general types of materials used in such applications: 1) integrally formed structural geogrids; 2) woven or knitted textiles; 3) open mesh woven or knitted textiles (which are generally configured to resemble and compete with integrally formed structural geogrids); and 4) non-woven textiles.

Integrally formed structural geogrids are formed by extruding a flat sheet of polymeric material, punching apertures in the sheet in a generally square or rectangular pattern and then uniaxially or biaxially stretching the apertured sheet, or by extruding an integrally formed mesh structure which constitutes a sheet with apertures in a generally square or rectangular pattern and then uniaxially or biaxially stretching the apertured sheet. Woven or knitted textiles are formed by mechanically interweaving or interlinking polymeric fibers or fiber bundles with conventional textile weaving or knitting technologies. Open mesh woven textiles are formed in this same manner and are normally coated in a subsequent process. Non-woven textiles are formed by various techniques including overlaying and mechanically entangling polymeric fibers, generally by needling, and in some processes the entangled polymeric fibers are then re-oriented in a biaxial stretching process, calendered and/or heat fused.

Integrally formed structural geogrids are well known in the market and are an accepted embodiment in many earthwork construction applications. Open mesh woven or knitted textiles, generally characterized and marketed as textile geogrids, compete directly with integrally formed structural geogrids in many applications and have also established an accepted position in earthwork construction markets. Competition between either of these "geogrid" materials and conventional woven or knitted textiles is less frequent. Woven or knitted textiles with low basis weight tend to be used in separation and filtration applications. Woven or knitted textiles with high basis weight tend to be used in load bearing applications which are tolerant to the load-elongation properties of such materials and which can beneficially use the high ultimate tensile strength of such materials. Non-woven textiles are generally subject to very high elongation under load and are not normally used in load bearing earthwork construction applications. Competition between either of the "geogrid" materials and non-woven textiles is negligible.

The characteristics of integrally formed structural geogrids and open mesh woven or knitted textiles are significantly different in several respects. The integrally formed materials exhibit high structural integrity with high initial modulus, high junction strength and high flexural and torsional stiffness. Their rigid structure and substantial cross sectional profile also facilitate direct mechanical keying with construction fill materials, with contiguous sections of themselves when overlapped and embedded in construction fill materials and with rigid mechanical connectors such as bodkins, pins or hooks. These features of integrally formed structural geogrids provide excellent resistance to movement of particulate construction fill materials and the integrally formed load bearing elements relative to each other, thereby preserving the structural integrity of foundation fill materials or preventing pull out of the embedded load bearing elements in earth retention applications.

Integrally formed structural geogrids interact with soil or particulate construction fill materials by the process of the soil or construction fill materials penetrating the apertures of the rigid, integrally formed geogrid. The result is that the geogrid and the soil or construction fill materials act together to form a solid, continuously reinforced matrix. Both the longitudinal load bearing members and the transverse load bearing members and the continuity of strength between the longitudinal and the transverse load bearing members of the geogrid are essential in this continuous, matrix-like interlocking and reinforcing process. If the junction between the longitudinal and the transverse load bearing members fails, the geogrid ceases to function in this manner and the confinement and reinforcement effects are greatly reduced. Their rigid structure also facilitates their use over very weak or wet subgrades where placement of such load bearing materials and subsequent placement of construction fill materials is difficult.

The open mesh woven or knitted materials exhibit higher overall elongation under load, lower initial modulus, softer hand and greater flexibility. With sufficient increase in the number of fibers or fiber bundles comprising their structure they are capable of achieving higher ultimate tensile strength than integrally formed structural geogrids. However, they also exhibit low junction strength which limits their effectiveness in direct mechanical keying with construction fill materials, with contiguous sections of themselves when embedded in construction fill materials or with rigid mechanical connectors. As a result, such materials are primarily used in applications which rely on a frictional interface with construction fill materials to transfer structural loads to the load bearing element and users of such materials also avoid applications which involve load bearing connections with rigid mechanical connectors. Also, their low flexural and torsional stiffness limit their practical usefulness and performance in certain earthwork applications such as construction over very weak subgrades or construction fill reinforcement in foundation improvement applications.

The attributes which are most pertinent to the use of polymeric materials in structural load bearing earthwork construction applications are:

(a) the load transfer mechanism by which structural forces are transferred to the load bearing element, (b) the load capacity of the load bearing element;

(c) the structural integrity of the load bearing element when subjected to deforming forces in installation and use; and (d) the resistance of the load bearing element to degradation (i.e., loss of key properties) when subject to installation or long term environmental stress.

The limitations which open mesh woven or knitted textiles exhibit with respect to the first three attributes listed above primarily result from a lack of rigidity and tautness in the fibers or fiber bundles in the junction zones of these materials in which many separate fibers or fiber bundles are interlinked, interwoven or entangled in a manner which is characteristic of a woven or knitted structure and which does not cause the load bearing fibers or fiber bundles to be either taut or dimensionally stable relative to each other. The limitations which such materials exhibit with respect to the fourth attribute listed above primarily result from degradation of their coating materials and separation of such coating materials from the load bearing fibers.

Attempts have been made to dimensionally stabilize and protect the fibers or fiber bundles in the junction zones of open mesh woven or knitted textiles. For instance, such textiles are normally coated with another material such as polyvinylchloride after the principal textile structure is formed on a weaving or knitting loom. This technique improves the dimensional stability of the fibers or fiber bundles in the junction zone to some extent and also provides some protection from abrasion to the fibers throughout the textile. However, this technique has not delivered sufficient junction strength or sufficient initial modulus to enable such materials to be functionally comparable to integrally formed structural geogrids or to be directly competitive with integrally formed structural geogrids in certain demanding earthwork construction applications which require or benefit from load transfer by direct mechanical keying or high initial modulus or high structural integrity or stiffness in the load bearing element. The protective coatings also tend to degrade and separate from the load bearing fibers, thereby reducing their effectiveness in providing long term resistance to environmental degradation of the load bearing fibers and also creating a potential shear failure surface at the interface between the load bearing fibers and the coating material.

SUMMARY OF THE INVENTION

It is an object of the present invention to provide an open mesh textile which has improved suitability for use as a structural load bearing element in demanding earthwork construction applications.

It is another object of the present invention to provide an open mesh textile with improvements over the prior art in one or more of the following attributes:

(a) its load transfer mechanism (specifically its suitability for direct mechanical keying with construction fill materials, with contiguous sections of itself when overlapped and embedded in construction fill materials and with rigid mechanical connectors such as bodkins, pins or hooks);

(b) its load capacity (specifically its initial modulus, i.e., its resistance to elongation when initially subject to load);

(c) its structural integrity (specifically its junction strength and its flexural and torsional stiffness); and (d) its durability (specifically its resistance to degradation when subject to installation and long term environmental stress).

These and other objects of the present invention will become apparent with reference to the following specification and claims.

Bonded composite open mesh structural textiles according to the present invention are open mesh woven textiles formed from at least two and preferably three independent but complementary polymeric components. The first component, the load bearing element, is a high tenacity, high initial modulus, low elongation monofilament or multifilament polymeric fiber or bundle of such fibers with each fiber being of homogenous or bicomponent structure. Where bicomponent fibers or fiber bundles are used to form such load bearing elements it is possible to achieve improved resistance to degradation (i.e., loss of key properties) when such materials are subject to installation and long term environmental stress in use (i.e., by using a core material most suited to achievement of desired mechanical properties and a different sheath material most suited to achievement of desired durability properties in a particular field of use). The second component, a bonding element, is an independent polymeric material in monofilament or multifilament form and of homogenous or bicomponent structure which is used to encapsulate and bond the load bearing fibers particularly in the junction zones of the open mesh textile thereby strengthening the junction, stiffening the composite material, increasing its resistance to elongation under load and increasing its resistance to degradation when subject to installation or long term environmental stress. The third component, when used, is an effect or bulking fiber which increases the cross section of the bonded composite open mesh structural textile thereby further increasing its stiffness and increasing its effectiveness in mechanically interlocking (keying) with particulate construction fill materials.

In the bonded composite open mesh woven textile a plurality of warp fibers (commonly referred to as yarns) are closely interwoven with a plurality of weft yarns. The weave preferably includes a half cross or full cross leno weave. At least a portion of the warp and weft yarns are first component load bearing yarns. The second polymer component is used as required for the bonding properties necessary for the finished product, and especially to provide improved junction strength. The effect or bulking yarns are used as warp and/or weft yarns and/or leno yarns. The effect or bulking yarns increase friction with adjacent yarns to provide better stability and structural integrity in the overall material. Two or more effect or bulking yarns interlacing with one another provide the greatest stability and highest junction strength. The effect or bulking yarns also provide the desired bulk in the textile and relatively thick cross sectional profile for the finished product to improve its stiffness and its effectiveness in mechanically interlocking with particulate construction fill materials.

The second component may be incorporated into the textile in several ways. The second component may be provided by a fusible bonding yarn, either monofilament or multifilament, which is preferably a bicomponent yarn having a low melting temperature sheath and a high melting temperature core. In the woven textile, the fusible bonding yarns may be used as warp and/or weft yarns and/or leno yarns to provide the improved junction strength. Alternatively, the second component may be provided by a suitable polymer applied and bonded to the textile by any of a number of different processes after the textile leaves the loom. The second component also may be provided by a combination of a fusible bonding yarn and an additional polymeric material independently applied and bonded to the textile.

In accordance with one embodiment of the invention where a fusible bonding yarn is used, the woven textile is heated to melt the fusible polymer component, i.e., to melt the monofilament bonding fibers or the sheath of the bicomponent bonding fibers. This causes the fusible polymer component to flow around and encapsulate the other components of the textile and protects, strengthens and stiffens the overall structure and particularly the junctions. In accordance with another embodiment of the invention, the woven textile is impregnated with a suitable polymer which flows around and encapsulates the other components of the textile, especially the junctions. The impregnated textile is then heated to dry and/or cure the polymer to bond the yarns especially at the junctions. In accordance with yet another embodiment of the invention, a polymer sheet or web is applied to the woven textile and heated to melt the sheet or web causing the polymer to flow around and encapsulate the other components of the textile.

The materials produced according to the present invention can also be modified for various applications by selection of the type and number and location of the first component load bearing yarns and the type and number and location of the second component fusible bonding yarns and/or other independent polymeric bonding materials, and the type and location of the optional third component bulking yarns. Thus, the material can be custom tailored for particular applications. Materials produced according to the present invention can also easily be designed and manufactured to achieve specific tensile properties in the longitudinal direction or both the longitudinal and transverse directions. This flexibility enables more efficient use of the instant invention in demanding earthwork applications which often have widely varying and site specific needs. The use of fusible yarns and/or other polymeric bonding materials to strengthen the junctions and/or increase overall material stiffness also permits increased flexibility in the design and commercial use of such materials. Inexpensive bulking yarns may also be used in a variety of economical ways to provide bulk and increased cross sectional profile without sacrificing strength or other desirable characteristics. For example, some or all warp or weft yarn bundles may be selected to provide a thick profile through the addition of bulking yarns or additional strength yarns. The resulting thick profile, either in all yarn bundles or in certain selected yarn bundles, for example every sixth weft yarn bundle, will provide improved resistance to pullout. The thick yarn bundle profile in the bonded composite open mesh structural textile functions in a manner similar to the vertical cross sectional faces of an integrally formed structural geogrid. Finally, materials produced according to the present invention can be manufactured using conventional, inexpensive, widely available weaving equipment which minimizes the cost of production of such materials.

Materials produced according to the present invention have a number of advantages compared to conventional open mesh woven or knitted textiles, the collective effect of which is to render materials produced according to the present invention much more suitable for use in demanding earthwork construction applications. The primary benefits of the inventive concepts embodied in materials produced according to the present invention are described below:

| | Feature | Benefit |
|---|---|---|
| 1. | Improved junction strength | causes structural forces in demanding earthwork construction applications to be transferred to the load bearing elements of the instant invention by means of positive mechanical interlock with construction fill materials as well as by frictional interface with such construction fill materials; also enables use of the instant invention in applications requiring or favoring use of rigid mechanical connectors such as bodkins, pins or hooks |
| 2. | Improved cross sectional profile | causes load bearing elements transversely oriented relative to structural forces in demanding earthwork construction applications to present an increased abutment interface to particulate construction fill materials, thereby substantially increasing their resistance to movement relative to such particulate construction fill materials (commonly called pull out resistance) |
| 3. | Improved initial modulus | causes structural forces in demanding earthwork applications to be transferred to the load bearing elements of the instant invention at very low strain levels, thereby substantially reducing deformation in the earthwork structure and substantially increasing the efficiency of use of such load bearing elements in demanding earthwork construction applications |
| 4. | Improved flexural stiffness | causes the matrix of transversely oriented load bearing elements in the instant invention to resist in plane deflection, thereby increasing its ease of installation, particularly over very weak or wet subgrades and increasing its capacity to support construction fill materials initially placed on top of such subgrades |
| 5. | Improved torsional stiffness | causes the matrix of transversely oriented load bearing elements in the instant invention to resist in plane or rotational movement of particulate construction fill materials when subject to dynamic loads such as a moving vehicle causes in an aggregate foundation for a roadway thereby increasing the load bearing capacity of the particulate construction fill materials and increasing the efficiency of use of such load bearing elements in such demanding earthwork construction applications |
| 6. | Improved resistance to | causes the instant invention to |

-continued

| Feature | Benefit |
|---|---|
| degradation | have improved suitability for use in earthwork construction applications which involve exposure to significant mechanical stress in installation or use and/or involve exposure to significant long term environmental (i.e., biological or chemical) stress in use |
| 7. Improved flexibility in product design and manufacture | enables widely disparate and complementary properties to be embodied in the instant invention via the independent polymeric materials chosen for use in each of the three components of the instant invention (the load bearing element, the bonding element and the bulking element) or chosen for use in the independent polymeric materials comprising the core or sheath components of any of these three elements and also enables the type and number and location of all such components of the instant invention to be economically varied without substantial modification of manufacturing equipment |
| 8. Improved efficiency in product use | enables users of the instant invention to exploit the various product features and the flexibility in choosing and using variants of such features all as described above to achieve performance and productivity gains in a wide variety of earthwork construction applications |
| 9. Improved suitability for use in demanding earth-work construction | causes the instant invention, by virtue of the collective features and benefits described above, to have greater opportunity for use in markets involving demanding earthwork construction applications than has heretofore been enjoyed by open mesh woven or knitted textiles |

BRIEF DESCRIPTION OF THE DRAWINGS

FIG. 3 (B) is an exploded schematic plan view of a portion of the bonded composite open mesh structural textile construction of FIG. 3 showing another variation in the leno weave.

DETAILED DESCRIPTION OF THE PREFERRED EMBODIMENTS

Figure 1:
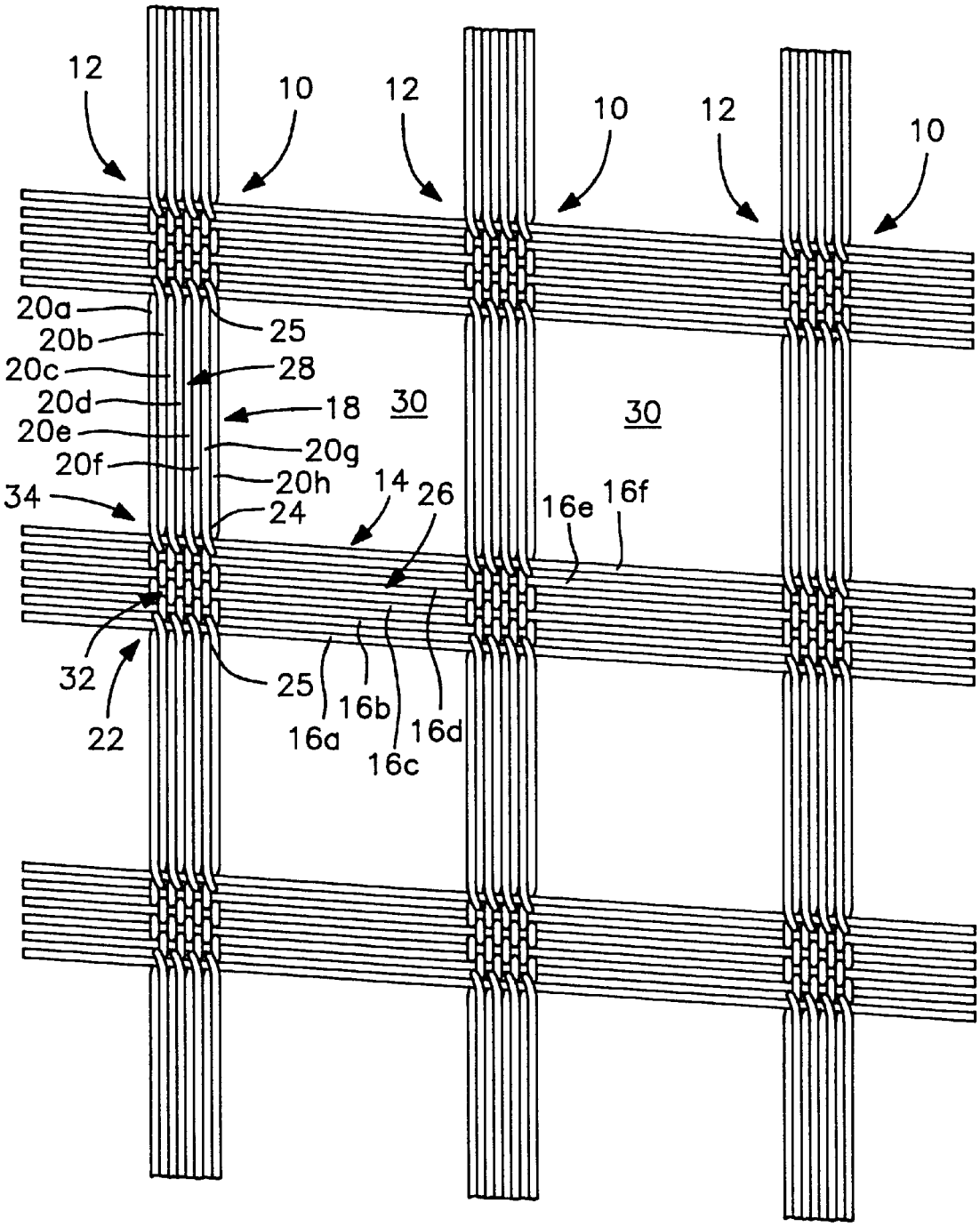
FIG. 1 is a perspective view of a bonded composite open mesh structural textile according to the present invention.
Figure 2:
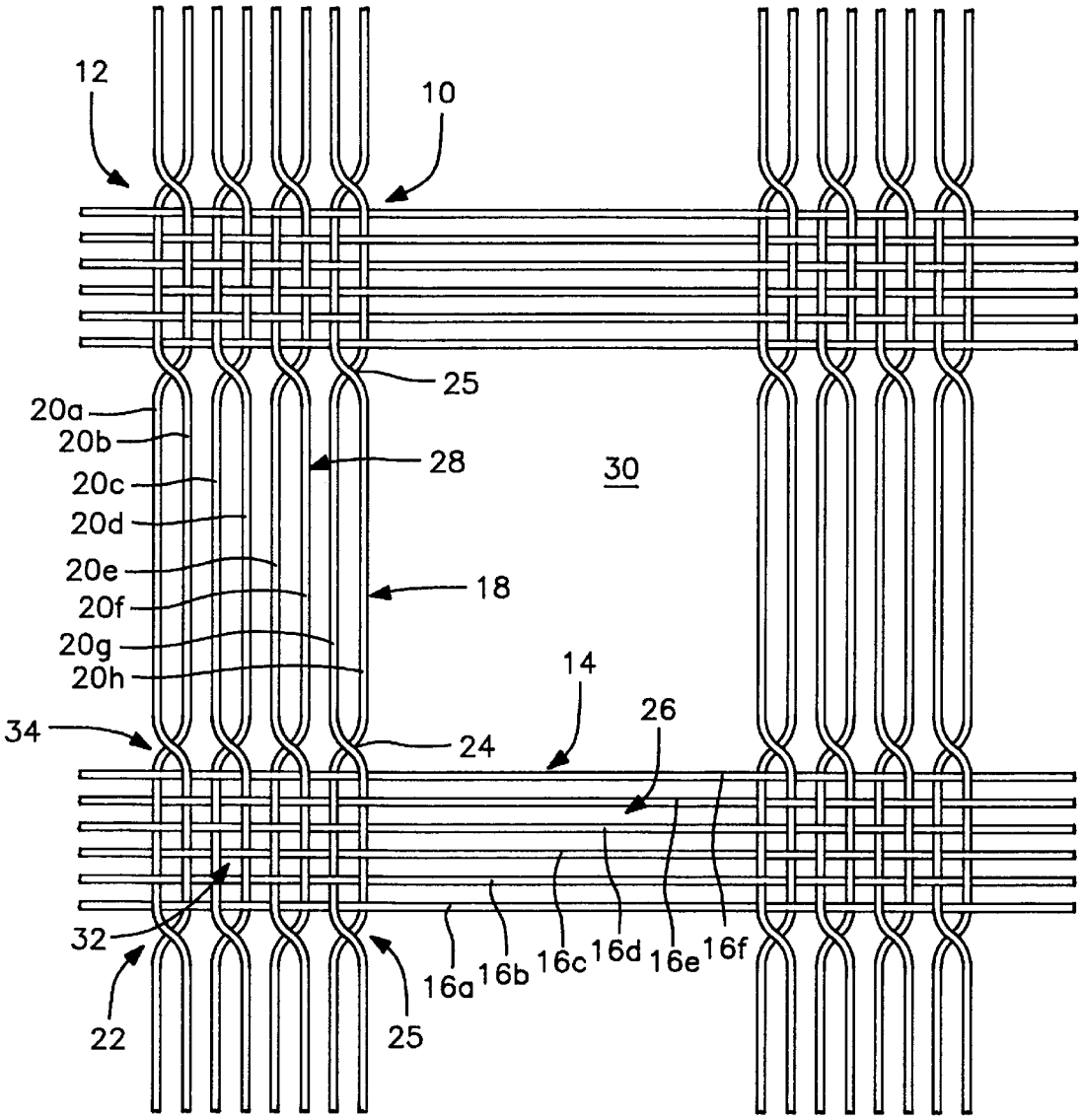
FIG. 2 is an exploded schematic plan view of a portion of the bonded composite open mesh structural textile of FIG. 1.

Referring to FIGS. 1 and 2, the bidirectional woven textile 10 is formed into the openwork apertured structure or open mesh textile 12 of the present invention. Textile 10 is formed of a plurality of spaced apart weft yarn bundles 14. Each weft yarn bundle is formed of a plurality of weft, filling or pick yarns 16 (16*a–f*). Each bundle 14 of weft yarns 16 includes edge weft or pick yarns 16*a* and 16*f*. The weft yarn bundles 14 are woven together with a plurality of spaced apart warp yarn bundles 18. Each of the warp yarn bundles 18 is formed of a plurality of warp yarns 20 (20*a–h*). Each bundle of warp yarns 18 includes edge warp yarn pairs 20*a–b* and 20*g–h*.

At the junctions or joints 22 of the open mesh textile 12, the weft yarns 16 are interlaced or interwoven with the warp yarns 20. At least four weft yarns 16 are interlaced or interwoven with at least four warp yarns 20 at the junctions or joints 22 of the open mesh textile 12. As illustrated in FIGS. 1 and 2, each weft yarn 16 (e.g., 16*d*) is interlaced with the warp yarns 20 independently of adjacent weft yarns 16 (e.g., 16*c* and 16*e*), and each warp yarn 20 (e.g., 20*d*) is interlaced with the weft yarns 16 independently of adjacent warp yarns 20 (e.g., 20*c* and 20*e*). The weft yarns 16 and warp yarns 20 are interlaced in a plain weave (1/1) as illustrated in FIGS. 1 and 2. However, the weft yarns 16 and warp yarns 20 also could be interlaced in other relatively highly interlaced weave patterns such as a twill weave (e.g., 1/2, 2/1, 3/1, 1/3, 2/2, 3/3).

As illustrated in FIGS. 1 and 2, the warp ends of adjacent warp yarn pairs 20*a* and 20*b*, 20*c* and 20*d*, 20*e* and 20*f*, and 20*g* and 20*h*, respectively, are alternately twisted in a right- and left-hand direction crossing at 24 (180°) and 25 (180°) to provide a complete twist (360°) or full-cross leno weave between adjacent weft yarn bundles 14. Alternatively, the warp ends of adjacent warp yarns 20 are twisted in only one direction between adjacent weft yarn bundles 14 to form a half twist (180°) or half-cross leno weave (not shown) between adjacent weft yarn bundles 14.

The woven textile of the present invention may be formed on any conventional loom such as a Rapier loom. As illustrated in FIGS. 1 and 2, each weft yarn bundle 14 has six weft yarns 16*a–f* and each warp yarn bundle 18 has eight warp yarns 20*a–h*. The loom will typically throw fourteen to twenty-four false picks for a complete cycle of twenty to thirty picks. The maximum total picks per inch will typically be about 20 to 36. The number of warp ends per inch will typically be about 6 to 18.

The open mesh textile 12 has lateral or cross-machine members 26 (weft yarn bundles 14) and longitudinal or machine direction members 28 (warp yarn bundles 18) which interconnect at the junctions 22 to define relatively large openings 30 through which soil, water or other material may pass when the open mesh textile 12 is placed in the earth. The openings 30 will typically be about ¾ to 1 inch. While openings 30 are illustrated as square, the openings may be rectangular. If desired, the openings 30 may be up to 12 inches or more in the warp direction. There could be as few as 6 to 10 weft yarns (in one cross member) per 12 inches of warp which would produce an unbalanced structure analogous to a uniaxially oriented integrally formed structural geogrid. The shape and size of the openings 30 will depend on the performance requirements of the open mesh textiles; however, the shape and size of the openings can be selected by adjusting the relative positioning of the weft yarn bundles 14 and the warp yarn bundles 18. Open mesh textile 12 has a first side 32 and second side 34.

Figure 3:
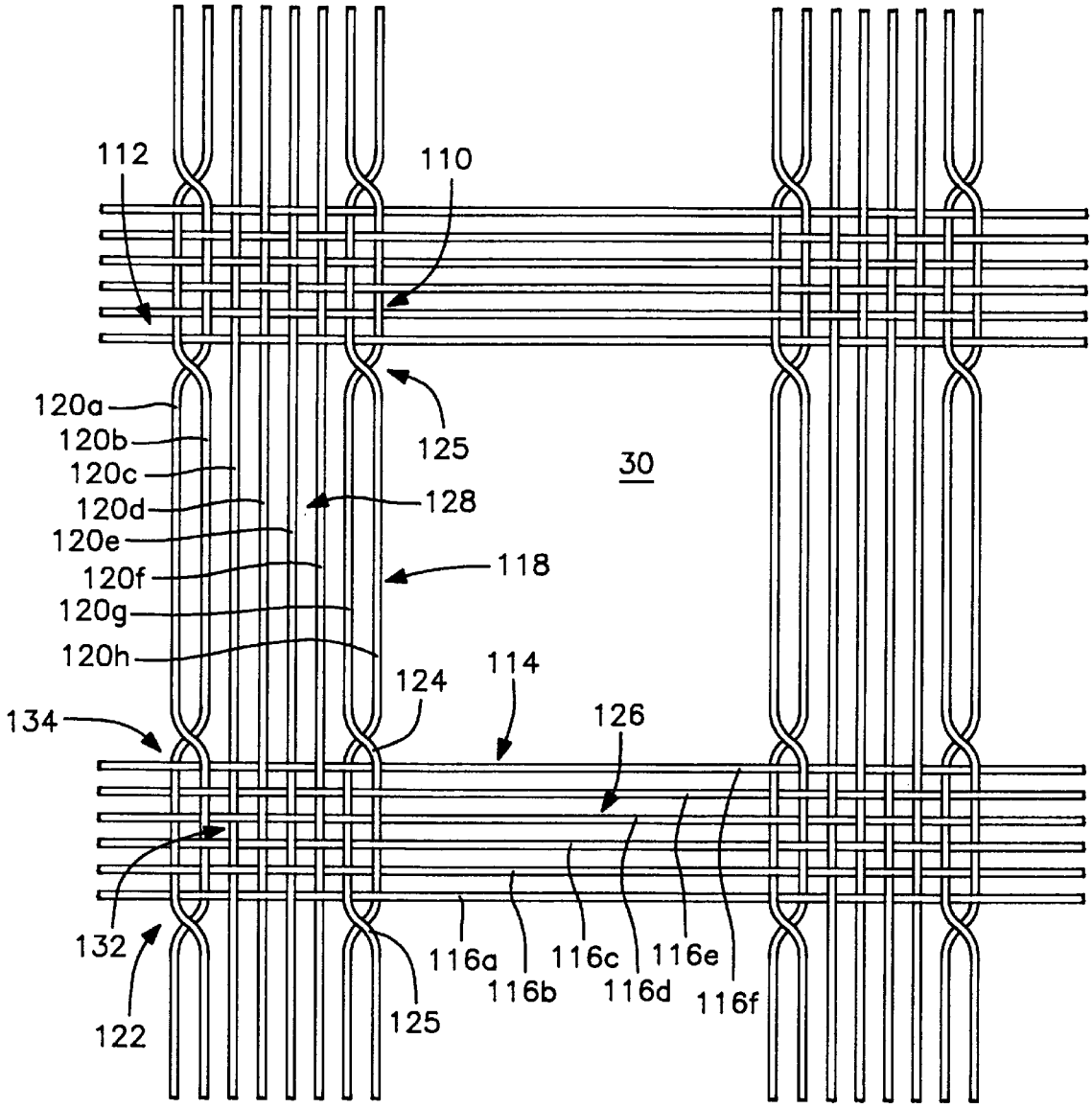
FIG. 3 is an exploded schematic plan view of a portion of a bonded composite open mesh structural textile construction according to the present invention showing another weaving pattern.
Figure 3A:
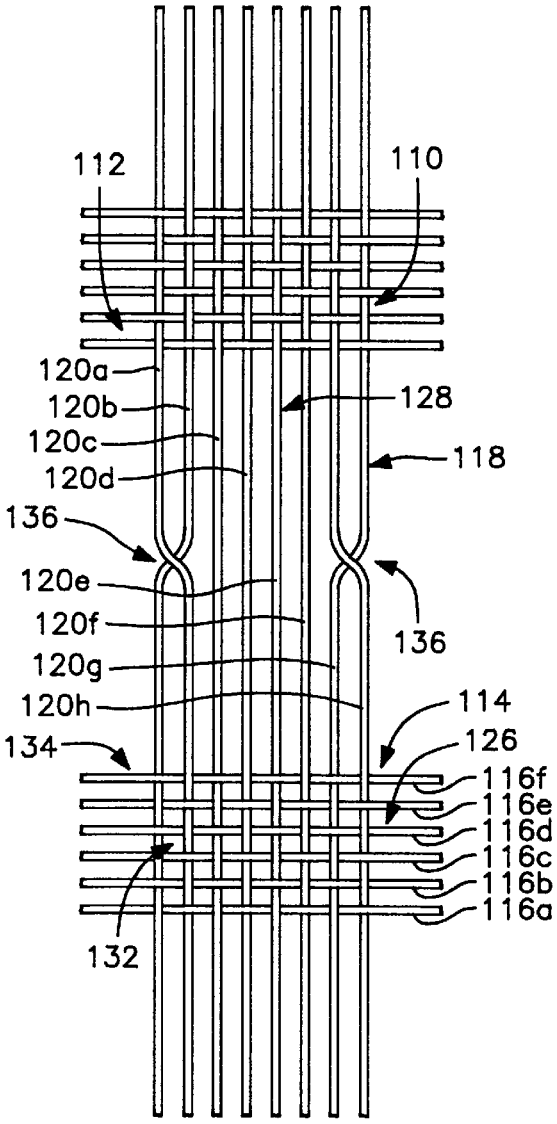
FIG. 3(A) is an exploded schematic plan view of a portion of the bonded composite open mesh structural textile construction of FIG. 3 showing a variation in the leno weave.
Figure 3B:
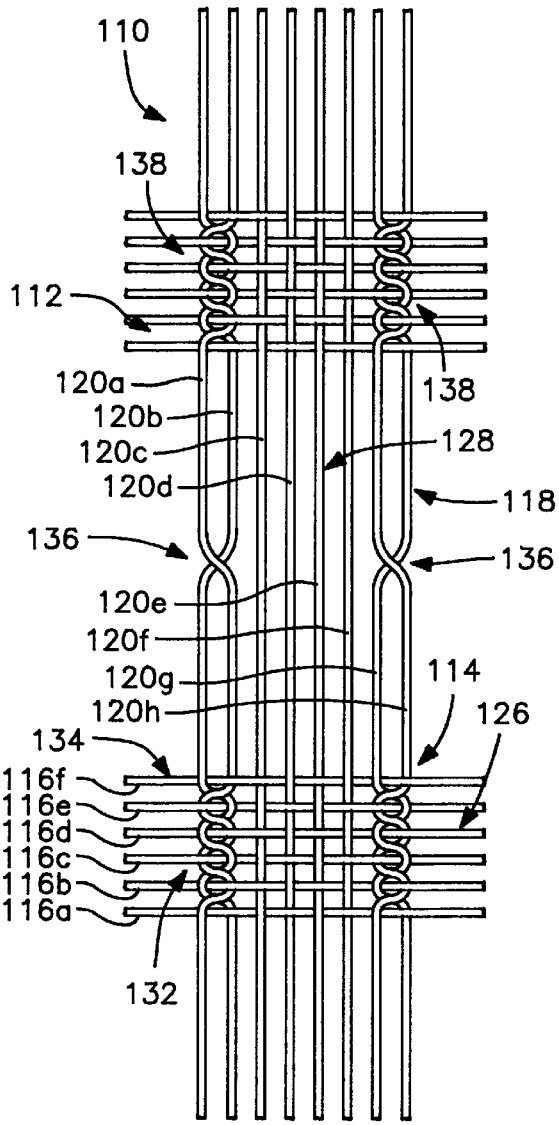
Figure 4:
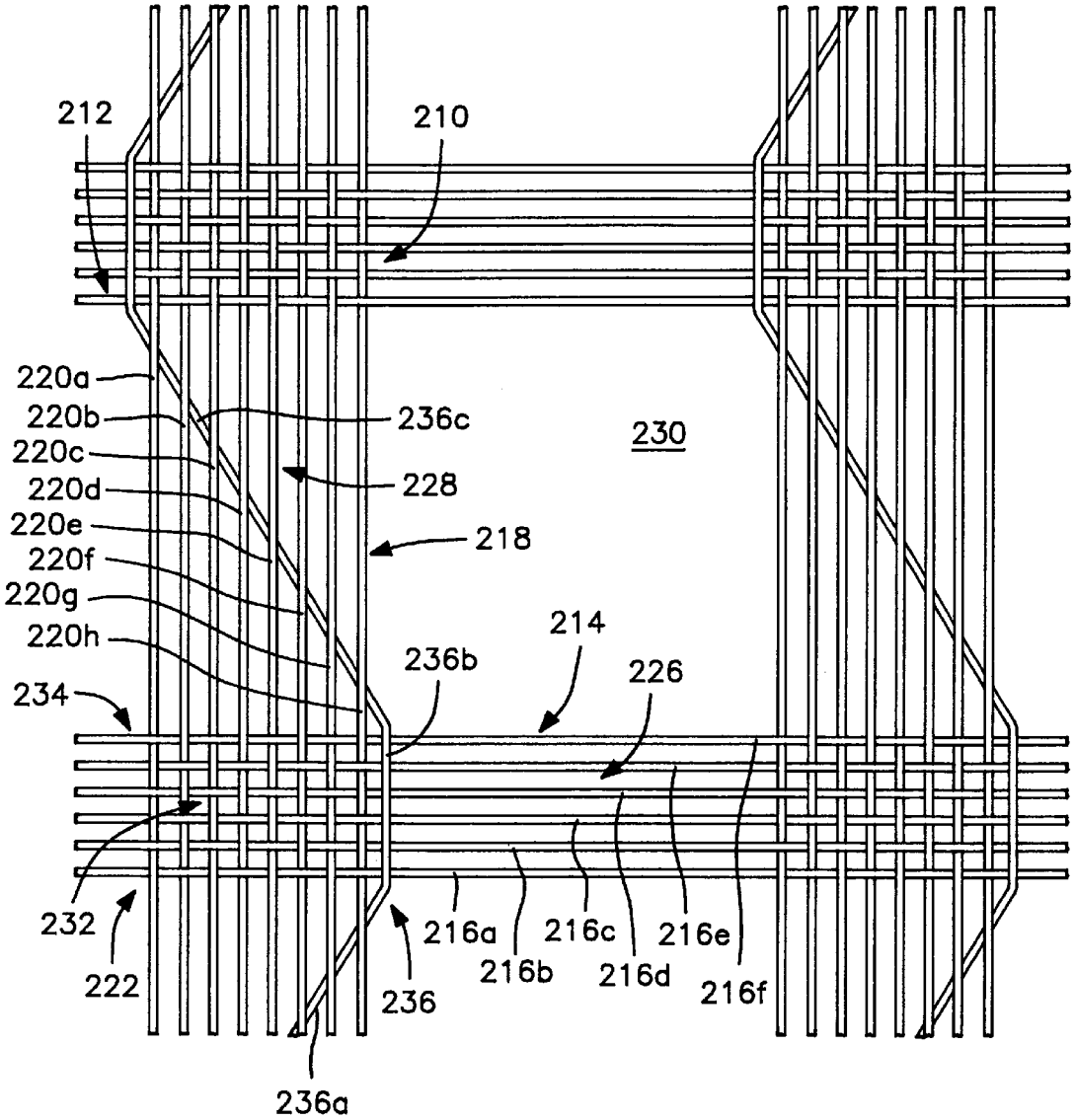
FIG. 4 is an exploded schematic plan view of a portion of a bonded composite open mesh structural textile construction according to the present invention showing yet another weaving pattern.
Figure 5:
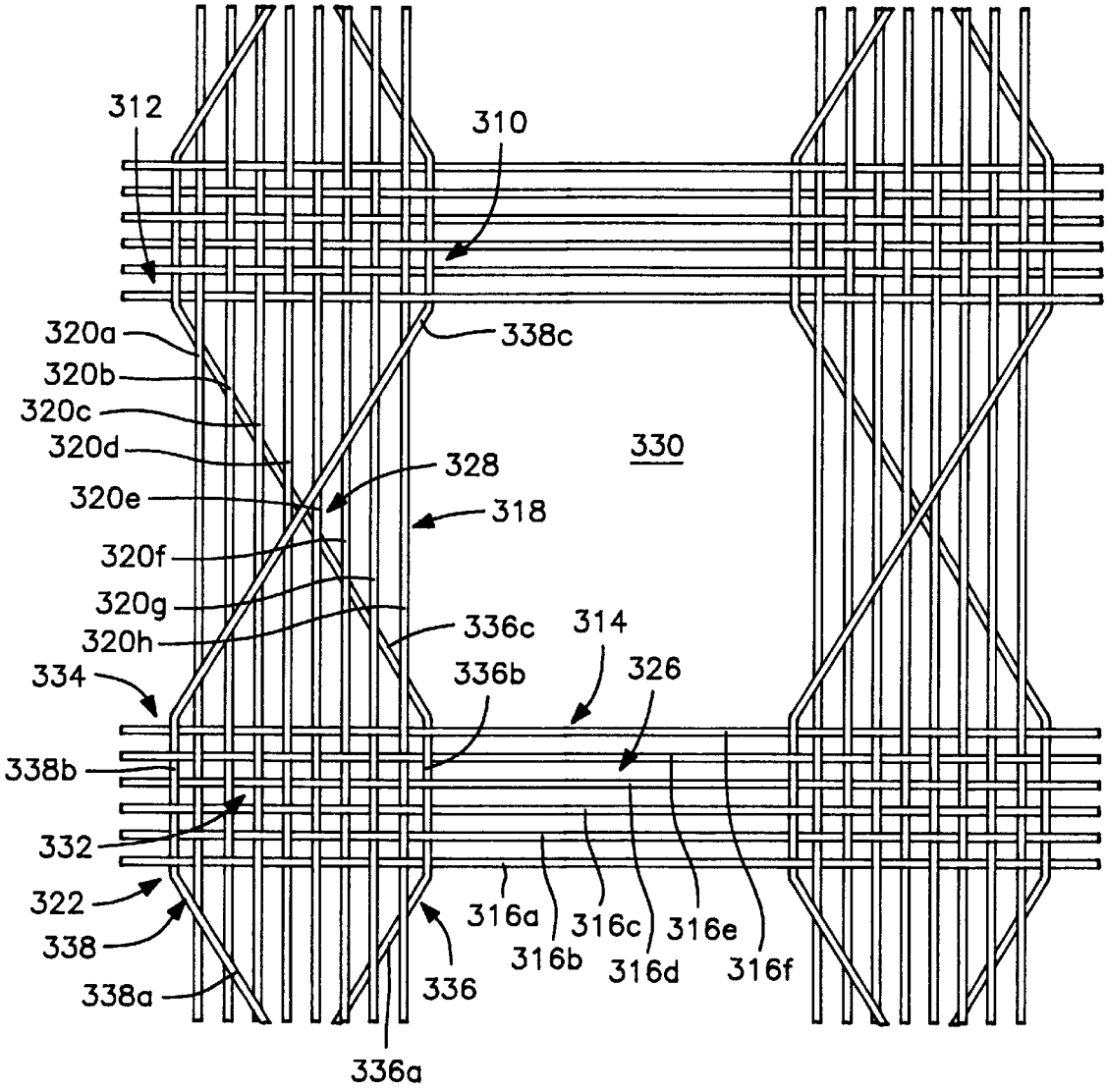
FIG. 5 is an exploded schematic plan view of a portion of a bonded composite open mesh structural textile construction according to the present invention showing a further weaving pattern.

FIGS. 3–5 show additional woven textile constructions according to the present invention in which the same reference numerals are used as in FIG. 1 for the same components or elements except in the "100", "200" and "300" series, respectively. More specifically, FIG. 3 shows a woven textile construction 110 which is similar to woven textile 10 of FIG. 1 except only the warp ends of adjacent warp yarn pairs 120*a* and 120*b*, and 120*g* and 120*h*, respectively, encircle with a half twist at 124 (180°) and 125 (180°) to provide a complete twist (360°) or full-cross leno weave between adjacent weft yarn bundles 114. As with respect to FIGS. 1 and 2, alternatively the warp ends of warp yarn pairs 120*a* and 120*b*, and 120*g* and 120*h*, respectively, may encircle with only a half twist (180°) between adjacent weft yarn bundles 114 to form a half-cross leno weave 136 between adjacent weft yarn bundles 114 as shown in FIG. 3(A). As a further alternative, the warp ends of adjacent warp yarn pairs 120*a* and 120*b*, and 120*g* and 120*h*, respectively, may form a half-cross leno weave 138 between adjacent weft yarns 116*a–f* as shown in FIG. 3(B), i.e., the warp ends may encircle with a half twist (180°) between adjacent weft yarns 116*a–f*.

FIG. 4 shows another woven textile construction 200. In this construction, a leno yarn 236 is woven in yet another form of half-cross leno weave into textile construction 210. Leno yarn 236 is woven at section 236*a* diagonally to warp yarn bundle 218 along second side 234 of textile 212, at section 236*b* parallel to warp yarn bundle 218 along first side 232 of textile 212, and at section 236*c* diagonally to warp yarn bundle 218 along second side 234 of textile 212. Alternatively, section 236*b* of leno yarn 236 may be interlaced or interwoven with weft yarns 216 of weft yarn bundle 214. Leno yarn 236 is woven under tension and gives firmness and compactness to weft and warp yarn bundles 214 and 218, preventing slipping and displacements of weft yarns 216 and warp yarns 220. Leno yarn 236 also increases the strength of junction 222.

FIG. 5 shows a woven textile construction 310 which is similar to woven textile construction 110 of FIG. 3 except two leno yarns 336 and 338 are woven in still another half-cross leno weave into woven textile construction 310 and both sections 336*b* and 338*b* of leno yarns 236 and 238, respectively, are interlaced or interwoven with weft yarns 316 of weft yarn bundle 314. Also, leno yarn 338 is woven at section 338*a* diagonally to warp yarn bundle 318 along first side 332 of textile 312 and at section 338*c* diagonally to warp yarn bundle 318 along first side 332 of textile 312. Both leno yarns 336 and 338 are woven under tension to prevent slipping and displacements of weft yarns 316 and warp yarns 320 and to increase the strength of junction 322.

FIGS. 3–5 are exploded schematic plan views like FIG. 2. However, it should be understood that the junctions 122, 222 and 322 in FIGS. 3–5, respectively, are tightly interlaced or interwoven in similar manner to the junction 22 illustrated in FIG. 1.

A majority of the weft and warp yarns are preferably the load bearing member, namely, the high tenacity, low modulus, low elongation mono- or multifilament yarns. Suitable mono- or multifilament yarns are formed from polyester, polyvinylalcohol, nylon, aramid, fiberglass, and polyethylene naphthalate.

The load bearing member should have a strength of at least about 5 grams per denier, and preferably at least about 9 to 10 grams per denier. The initial Young's modulus of the load bearing member should be about 100 grams/denier, preferably about 150 to 400 grams/denier. The elongation of the load bearing member should be less than about 18%, preferably less than about 10%. The load bearing member will typically have a denier of about 1,000 to 2,000, preferably about 2,000 to 8,000.

The textiles can be produced with approximately equal strength in the longitudinal or machine direction and in the lateral or cross-machine direction. Alternatively, the textiles can be produced with greater strength in either the longitudinal direction or the lateral direction. The selection of the strength characteristics of the textiles will be determined based on the requirements of the application design.

The fusible bonding yarns, if incorporated into the weave, are used as warp and/or weft yarns and/or leno yarns as required for the desired bonding properties, and especially the bonding properties needed to form the necessary strength of the junctions. When the textile is heated to melt the fusible polymer component, the fusible polymer component flows around and encapsulates other components of the textile bonding and stabilizing the textile structure and protecting the load bearing yarns from abrasion and chemical attack. The fusible yarn may be a monofilament or multifilament form of yarn and of homogeneous or bicomponent composition.

The preferred fusible yarn is a bicomponent yarn such as one having a low melting sheath of polyethylene, polyisophthalic acid or the like, and a high melting core of polyester or the like. The bicomponent yarn also may be a side-by-side yarn in which two different components (one with low melting temperature and one with high melting temperature) are fused along the axis and having an asymmetrical cross-section, or a biconstituent yarn having one component dispersed in a matrix of the other component, the two components having different melting points. The low and high melting components also may be polyethylene and polypropylene, respectively, different melting point polyesters, or polyamide and polyester, respectively. The bicomponent yarn will typically be composed of 30 to 70% by weight of the low melting temperature component, and 70 to 30% by weight of the high melting temperature component. The fusible yarn also may be an extrusion coated yarn having a low melting point coating or a low melting point yarn (e.g., polyethylene) employed in the textile structure side-by-side with other yarns.

As an alternative to using fusible bonding yarns, or in addition to using fusible bonding yarns, the textile is impregnated with a suitable polymer after it leaves the loom. The textile may be passed through a polymer bath or sprayed with a polymer. The impregnating material typically comprises an aqueous dispersion of the polymer. In the impregnation process, the polymer flows around and encapsulates the other components of the textile, especially the junctions of the textile. The impregnated textile is then heated to dry and/or cure the polymer to bond the yarns especially at the junctions.

The polymer may be a urethane, acrylic, vinyl, rubber or other suitable polymer which will form a bond with the yarns used in the textile. The urethane polymer may be, for example, an aqueous dispersible aliphatic polyurethane, such as a polycarbonate polyurethane, which may be crosslinked to optimize its film properties, such as with an aziridine crosslinker. Suitable urethane polymers and crosslinkers are available commercially from Stahl U.S.A., Peabody, Mass. (e.g., UE-41-503 aqueous polyurethane and KM-10-1703 aziridine crosslinker) and Sanncorre Industries, Inc., Loeminister, Mass. (e.g., SANCURE® 815 and 2720 polyurethane dispersions). The acrylic polymer may be, for example, a heat reactive acrylic copolymer latex, such as a heat reactive, carboxylated acrylic copolymer latex. Suitable acrylic latexes are available from BF Goodrich, Cleveland, Ohio (e.g., HYCAR® 26138 latex, HYCAR® 26091 latex and HYCAR® 26171 latex). The vinyl polymer may be a polyvinylchloride polymer. The rubber polymer may be neoprene, butyl or styrene-butadiene polymer.

As another alternative to using fusible bonding yarns, or in addition to using fusible bonding yarns, a polymer sheet or web is applied to the textile after it leaves the loom and the textile/polymer sheet or web is heated to melt the polymer sheet or web causing the polymer to flow around and encapsulate the other components of the textile. The polymer sheet or web is typically in nonwoven form. The polymer sheet or web may be a polyester, polyamide, polyolefin or polyurethane sheet or web. Suitable polymer sheets are available commercially from Bemis Associates Inc., Shirley, Mass., as heat seal adhesive films. Suitable polymer webs are available commercially from Bostik Inc., Middleton, Mass. (e.g., Series PE 65 web adhesive).

The bonding process results in chemical and/or mechanical bonds throughout the structure of the textile, and particularly the junctions.

The effect or bulking yarns are used as warp and/or weft yarns and/or leno yarns. The effect or bulking yarns increase friction with adjacent yarns to provide better stability (fiber to fiber cohesion). Two or more effect or bulking yarns interlacing with one another provide the greatest stability and highest joint strength. The effect or bulking yarns also provide the desired bulk in the textile and relatively thick profile of the finished product. The bulking yarns are generally made from low cost, partially oriented, polyester, polyethylene or polypropylene yarns or the like. The individual bulking yarn components will typically have a denier of about 150 to 300, preferably about 300 to about 1,000.

The bulking yarns may be friction spun or textured yarns. Textured yarns are produced from conventional yarns by a known air texturing process. The air texturing process uses compressed air to change the texture of a yarn by disarranging and looping the filaments or fibers that make up the yarn bundle. The texturing process merely rearranges the structure of the yarn bundle with little changes in the basic properties of the individual filaments or fibers occurring. However, the higher the bulk, the higher the loss in strength and elongation. Friction spun yarns are produced by the DREF2 process from Fehere AG in Linz, Austria.

In addition to using individual load bearing yarns, the present invention also contemplates forming composite yarns prior to textile formation in which the load bearing yarn is combined with a fusible bonding yarn or a bulking yarn. The composite may be formed using air jet texturing in which the load bearing yarn comprises the core and the fusible bonding yarn or bulking yarn is textured. The core is fed with minimal overfeed and with an excess quantity of fusible or bulking yarn with substantially higher overfeed. The compressed air rearranges and loops the filaments or fibers of the fusible yarn or bulking yarn to increase the bulk of the composite yarn. Composite yarns incorporating the load bearing yarn may also be made by known techniques such as twisting or cabling. The fusible yarn, especially of the monofilament type, also may be combined with the bulking yarn prior to textile formation such as by parallel end weaving, or by twisting, cabling or covering (single or double helix cover).

Referring to FIGS. 1–5 again, the fusible bonding yarn or bulking yarn would typically be used as warp yarns 20*a* and 20*h*, or warp yarn pairs 20*a–b* and 20*g–h*, in FIGS. 1–2. In FIG. 3, warp yarns 120*a* and 120*h*, or warp yarn pairs 120*a–b* and 120*g–h*, would typically be fusible yarns or bulking yarns. In FIGS. 4 and 5, the fusible yarn or bulking yarn could be the leno yarn 236, and leno yarns 336 and 338, respectively. However, the fusible yarn or bulking yarn could be incorporated into the woven textiles illustrated in FIGS. 1–5 in many other ways.

A preferred construction of the present invention is illustrated in FIG. 3(B) in which the warp yarns 120*c–f* are high tenacity, high modulus, low elongation yarns (e.g., polyvinylalcohol), the warp yarns 120*a* and 120*b*, and 120*g* and 120*h*, are fusible bonding yarns (e.g., a bicomponent yarn having a low melting point polyisophthalic acid sheath and a high melting point polyester core) or bulking yarns (e.g., air jet textured polyester), and the weft yarns 116*a–f* are composite yarns having a load bearing yarn core and bulking yarn (e.g., an air jet textured yarn having a polyvinylalcohol core and a polyester bulking). The textile preferably includes a polymer impregnation formed by dipping the textile in a polymer bath (e.g., urethane or acrylic).

The woven textile of the present invention also may include electrically conductive components as warp and/or weft yarns. The electrically conductive components may be metal yarns or strips (e.g., copper), polymeric yarns, either monofilament or multifilament, rendered electrically conductive by adding fillers (e.g., carbon black, copper, aluminum) in the polymer during extrusion, an electrically conductive filament of a multifilament yarn, or a polymeric yarn having an electrically conductive coating. The electrically conductive components permit breaks to be detected in the woven textile in a known manner. The electrically conductive components also permit failures in other components of a composite civil engineering structure to be detected. The electrically conductive components also permit the woven textile to be used in electrokinetic and related applications.

The woven textile of the present invention can be finished by applying heat energy (e.g., calendaring, radio-frequency energy, microwave energy, infra-red energy and tentering) to the material to soften the fusible yarn (e.g., the sheath of a bicomponent yarn), dry and/or cure the polymer impregnating the textile or melt the polymer sheet or web to lock the yarns and textile material in place.

The results of the heating or finishing process are:

(a) the yarn bundles are protected against impact and abrasion;

(b) the textile is protected against impact and abrasion;

(c) the yarn bundles are stiffened with better resistance to elongation and with lower ultimate elongation;

(d) the textile is stiffened with better resistance to elongation and with lower ultimate elongation;

(e) the yarn bundles are frozen in a fixed bulk for better soil textile interaction;

(f) the textile is frozen in a fixed bulk for better soil textile interaction; and (g) the junctions are protected, strengthened and stiffened.

Figure 6:
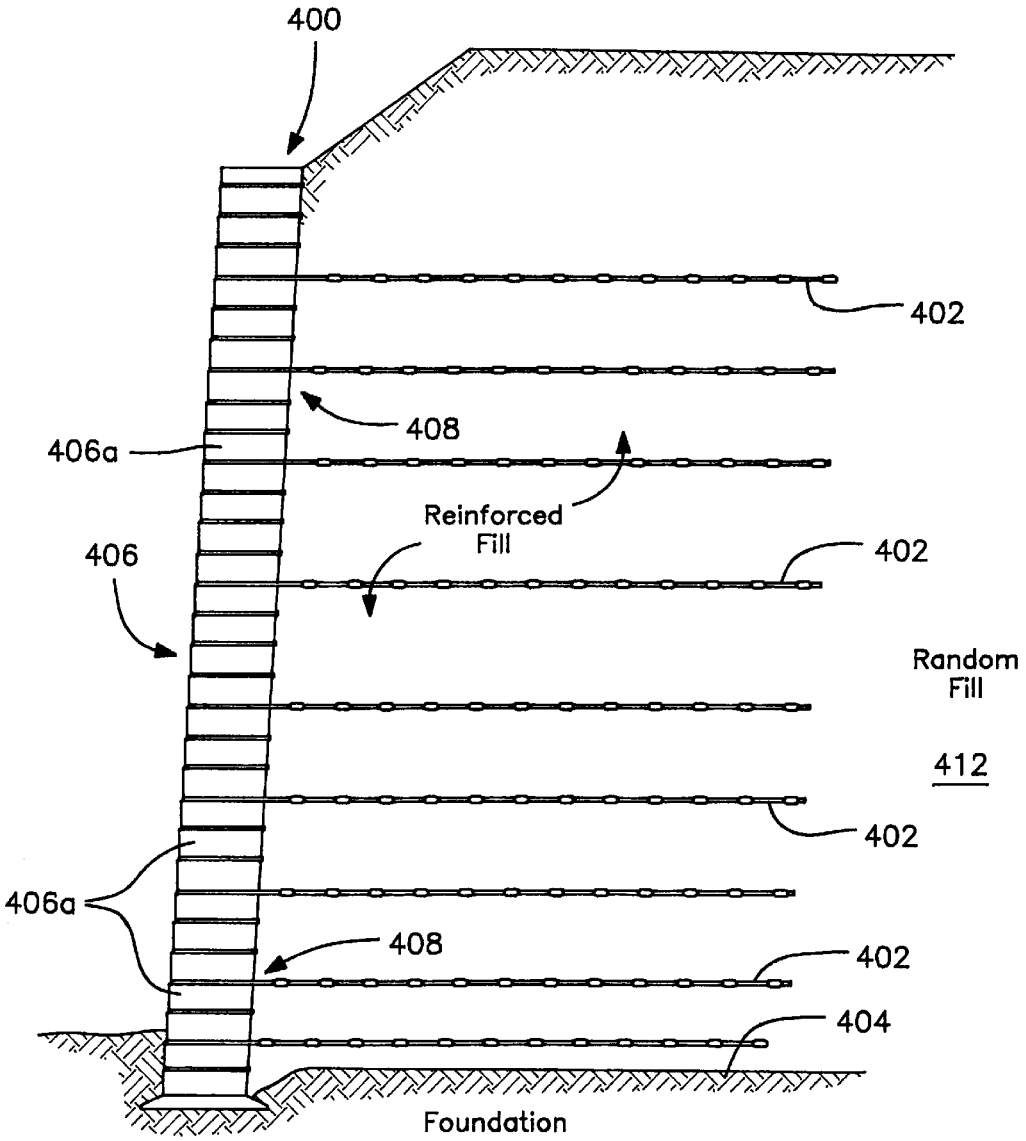
FIG. 6 is a schematic sectional view of a retaining wall formed using bonded composite open mesh structural textiles according to the present invention.

FIG. 6 shows a retaining wall 400 formed using the bonded composite open mesh textile 402 (e.g., textile 12 of FIGS. 1 and 2, textile 112 of FIG. 3, textile 212 of FIG. 4, or textile 312 of FIG. 5) of the present invention. Foundation or substrate 404 is graded to a desired height and slope. Retaining wall 406 is formed from a plurality of retaining wall elements 406*a*. A plurality of bonded composite open mesh structural textiles 402 are attached to the retaining wall 406 at 408. The open mesh structural textiles 402 are separated by a plurality of fill layers 410. Using this construction, random fill 412 is retained and held in place.

The retaining wall 406 is illustrated generically as comprising a plurality of courses of modular wall elements 406*a* such as conventional cementitious modular wall blocks. It is to be understood, however, that similar wall structures can be formed using modular wall blocks formed of other materials, including plastic. Likewise, retaining walls incorporating the bonded composite open mesh structural textiles of this invention can be constructed with cast wall panels or other conventional facing materials.

While no detail is shown for connection of the bonded composite open mesh structural textiles to the retaining wall elements, various techniques are conventionally used, including bodkin connections, pins, staples, hooks or the like, all of which may be readily adapted by those of ordinary skill in the art for use with the bonded composite open mesh structural textiles of this invention.

Figure 7:
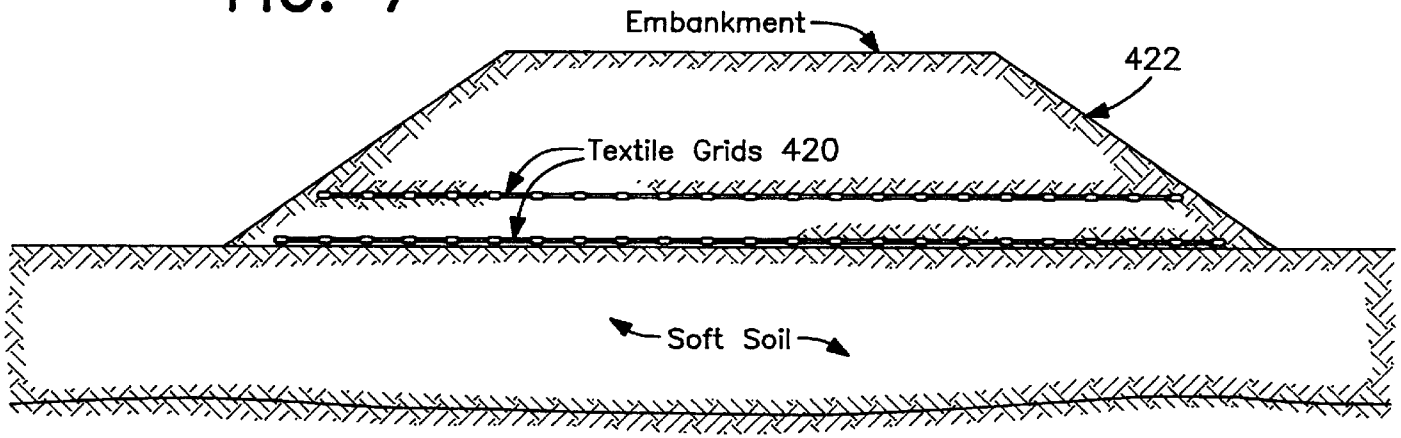
FIG. 7 is a schematic sectional view of a reinforced embankment constructed over weak foundation soils using bonded composite open mesh structural textiles according to the present invention.

When embankments are constructed over weak foundation soils the pressure created by the embankment can cause the soft soil to shear and move in a lateral direction. This movement and loss of support will cause the embankment fill material to shear which results in a failure of the embankment. This type of failure can be prevented by the inclusion of bonded composite open mesh structural textiles 420 (e.g., textile 12 of FIGS. 1 and 2, textile 112 of FIG. 3, textile 212 of FIG. 4, or textile 312 of FIG. 5) of the present invention in the lower portions of the embankment 422 as shown in FIG. 7. The bonded composite open mesh structural textiles 420 provide tensile strength that prevents the embankment from failing.

Figure 8:
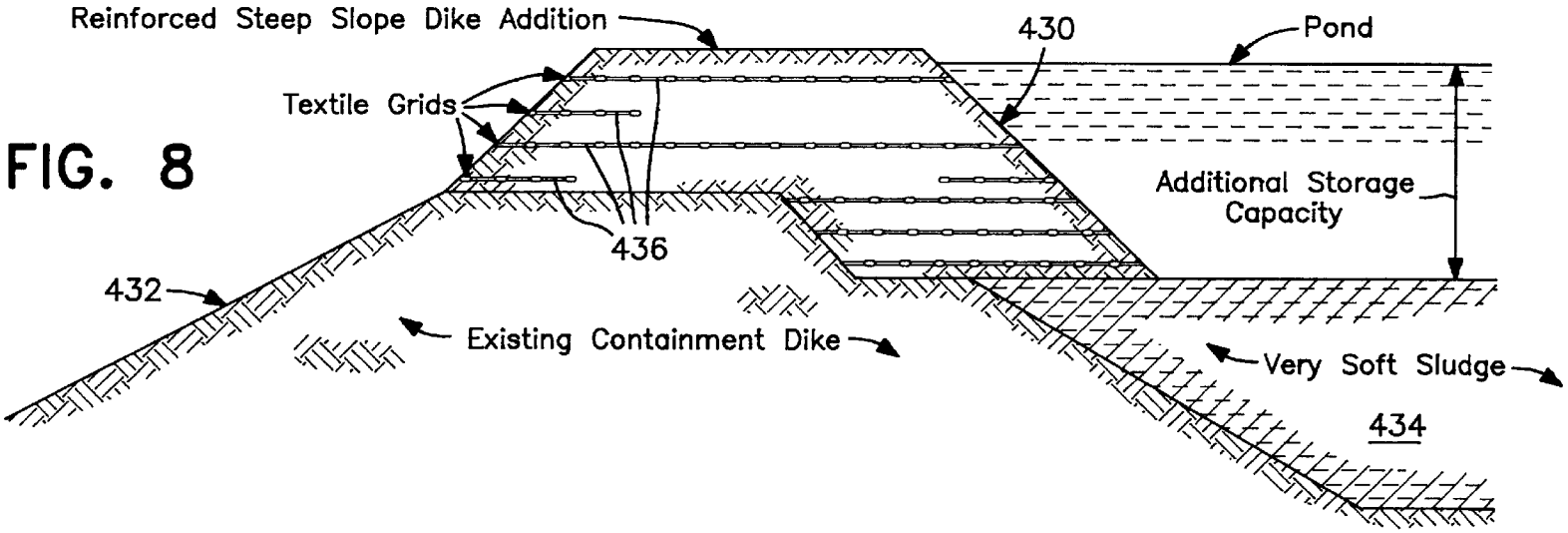
FIG. 8 is a schematic sectional view of a steepened reinforced earth slope which increases the capacity of sludge containment of a sludge containment pond using bonded composite open mesh structural textiles according to the present invention.

Reinforced earth structures may be built to steep slope angles which are greater than the natural angle of repose of the fill material by the inclusion of bonded composite open mesh structural textiles. Steep slopes can be used in many applications to decrease the amount of fill required for a given earth structure, increase the amount of usable space at the top of the slope, decrease the intrusion of the toe of the slope into wetlands, etc. In FIG. 8, a steep slope dike addition is shown. By using steep slopes 430, the amount of fill required to raise the dike elevation is reduced and the load that is placed on both the existing containment dike 432 and on the soft sludge 434 is also reduced. A dramatic increase in containment capacity is achieved through the use of steep slopes 430 reinforced with open mesh structural textiles 436 (e.g., textile 12 of FIGS. 1 and 2, textile 112 of FIG. 3, textile 212 of FIG. 4, or textile 312 of FIG. 5) of the present invention.

When embedding the bonded composite open mesh structural textiles of this invention in a particulate material such as soil or the like, the particles of aggregate engage the upper and lower surfaces of the textile and "strike through" the openings thereby forming a reinforcing and stabilizing function.

Figure 9:
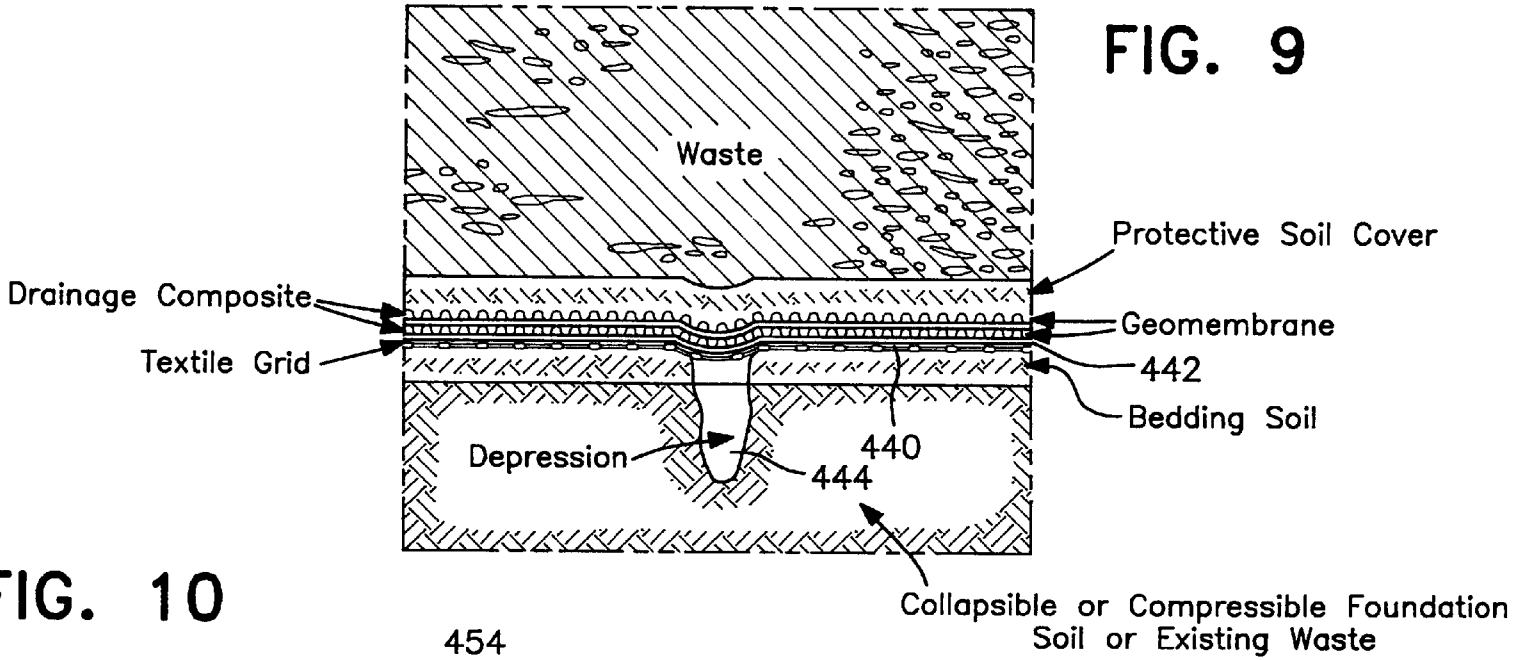
FIG. 9 is a schematic sectional view of a landfill liner support system provided by a bonded composite open mesh structural textile according to the present invention.

In addition to their earth reinforcement applications, the bonded composite open mesh structural textiles of this invention are especially useful in landfill and industrial waste containment constructions. Regulations require that the base and side slopes of landfills be lined with an impermeable layer to prevent the leachate from seeping into natural ground water below the landfill. When landfills are located over terrain which is compressible or collapsible, as in the case of Karst terrain, the synthetic liner will deflect into the depression. This deflection results in additional strains being induced into the liner which can cause failure of the liner and seepage of the leachate into the underlying ground water thus causing contamination. Through the use of the high tensile strength of textile 440 (e.g., textile 12 of FIGS. 1 and 2, textile 112 of FIG. 3, textile 212 of FIG. 4, or textile 312 of FIG. 5) of the present invention as shown in FIG. 9 liner 442 support can be provided by positioning the textile 440 immediately below the liner 442. Should any depression 444 occur, the high tensile capacity of the bonded composite open mesh structural textile 440 provides a "bridging" affect to span the depression and to minimize the strain induced into the liner 442 thereby helping to protect the landfill system from failure.

Figure 10:
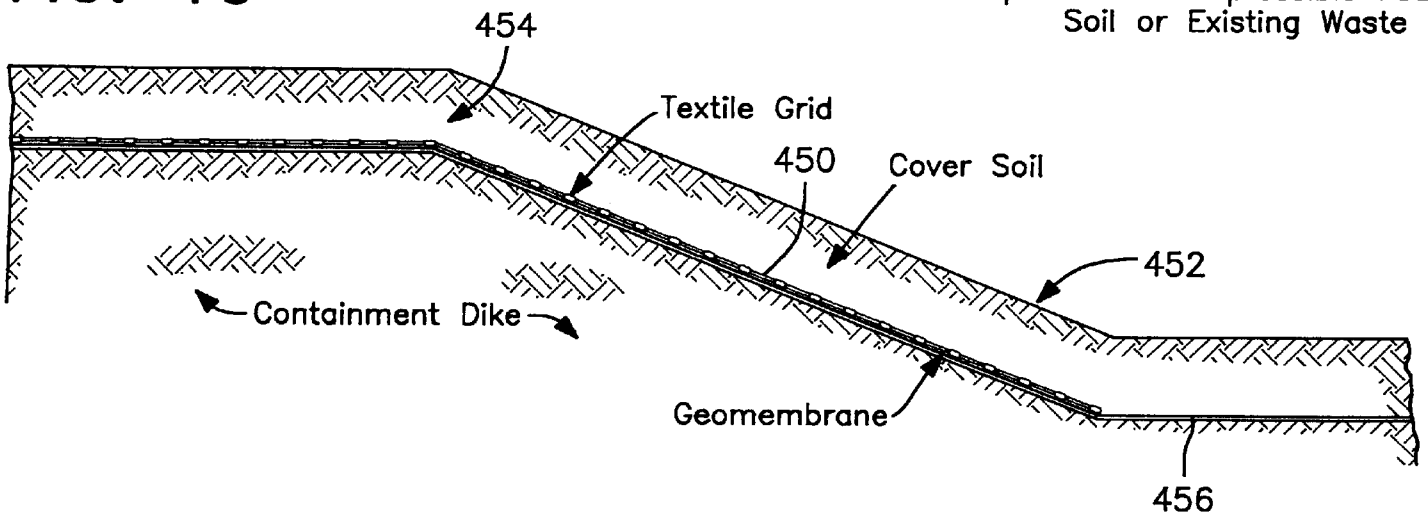
FIG. 10 is a schematic sectional view of a stabilized soil veneer on a steeply inclined landfill liner provided by a bonded composite open mesh structural textile according to the present invention.

Construction of landfills requires that the geomembrane liners be placed across the bottom of the landfill and up the side slopes of the landfill as well. In order to protect this liner, a layer of cover soil, known as a veneer, which has a dual purpose of liner protection against punctures from waste material placement and leachate collection if the cover soil has defined permeability is normally placed on top of the liner. Since the surface of the liner is smooth, the cover soil can fail by simply sliding down the slope since the friction between the soil and the liner is too small to support the weight of the soil layer. This type of failure can be prevented by the placement of a textile 450 (e.g., textile 12 of FIGS. 1 and 2, textile 112 of FIG. 3, textile 212 of FIG. 4, or textile 312 of FIG. 5) of the present invention as shown in FIG. 10 anchored at the top and extending down to the toe of the slope 452. The apertures (e.g., 30 in FIGS. 1 and 2, 130 in FIG. 3, 230 in FIG. 4 and 330 in FIG. 5) of the textile 450 allow the cover soil 454 to interlock with the textile 450 and the textile 450 in turn provides the tensile force required to hold this block of soil in place, thus eliminating the sliding on the liner 456.

Bonded composite open mesh structural textiles of the present invention also may be used in other earthwork construction applications to reinforce soil or earth structures such as foundation and pavement improvement systems and erosion protection systems. Additionally, these textiles may be used in the construction of geocells or retaining walls for marine use to control land erosion adjacent to waterways such as rivers, streams, lakes and oceans.

As indicated, while the textile materials of this invention have particular utility in earthwork construction applications, they are also adapted for any application where grid or net products have been used heretofore. For example, the novel textiles described herein have excellent strength and related characteristics for use in the formulation of gabions as well as in fencing applications or safety barriers. Additionally, they may be readily adapted for use in seat cushions, as mattress insulators and in diverse packaging applications, including pallet wraps and the like, and in various original equipment manufacturing applications.

Having described the invention, many modifications thereto will become apparent to those skilled in the art to which it pertains without deviation from the spirit of the invention as defined by the scope of the appended claims.

We claim:

1. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns; and the junctions of the bonded composite open mesh structural textile comprising at least one polymer component encapsulating and bonding yarns at the junctions to strengthen the junctions, the polymer component being formed by a fusible polymer component of a fusible bonding yarn which melts when heated and flows around adjacent yarns at the junctions.

2. The bonded composite open mesh structural textile of claim 1, wherein the fusible bonding yarn is a bicomponent yarn having a low melting temperature fusible component and a high melting temperature component.

3. The bonded composite open mesh structural textile of claim 2, wherein the bicomponent yarn is composed of 30 to 70% by weight of the low melting temperature sheath and 70 to 30% by weight of the high melting temperature core.

4. The bonded composite open mesh structural textile of claim 1, wherein the fusible bonding yarn comprises edge warp yarns or edge pairs of warp yarns of the warp yarn bundles.

5. The bonded composite open mesh textile of claim 1 wherein the junctions comprise at least four weft interwoven with at least four warp yarns.

6. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

the load bearing yarns being composite yarns in which the load bearing yarn is combined with a fusible bonding yarn;

the junctions of the bonded composite open mesh structural textile comprising at least one polymer component encapsulating and bonding yarns at the junctions to strengthen the junctions.

7. The bonded composite open mesh structural textile of claim 6, wherein the composite yarns are formed by air jet texturing.

8. The bonded composite open mesh structural textile of claim 6, wherein the composite yarns are formed by twisting, cabling or covering.

9. The bonded composite open mesh textile of claim 6 wherein the junctions comprise at least four weft yarns interwoven with at least four warp yarns.

10. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

the load bearing yarns having a strength of at least about 5 grams per denier, a modulus of at least about 100 grams per denier, an elongation of less than about 18% and a denier of about 1,000 to 8,000; and the junctions of the bonded composite open mesh structural textile comprising at least one polymer component encapsulating and bonding yarns at the junctions to strengthen the junctions.

11. The bonded composite open mesh textile of claim 10 wherein the junctions comprise at least four weft yarns interwoven with at least four warp yarns.

12. A bonded composite open mesh structural textile comprising:

a plurality of spaced-apart bundles of weft yarns;

a plurality of spaced-apart bundles of warp yarns, the warp yarns bundles intersecting with the weft yarn bundles at a plurality of junctions to define openings between adjacent weft and warp yarns bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising bulking yarns to provide a relatively thick profile for the textile;

a portion of the warp and weft yarns comprising load bearing yarns, the load bearing yarns being high tenacity, high modulus, low elongation yarns; and the junctions of the bonded composite open mesh structural textile comprising at least one polymer component encapsulating and bonding yarns at the junctions to strengthen the junctions, the bulking yarns being produced from partially oriented polyester, polyethylene or polypropylene yarns.

13. The bonded composite open mesh textile of claim 12 wherein the junctions comprise at least four weft yarns interwoven with at least four warp yarns.

14. The bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

the junctions of the open mesh textile comprising at least one leno yarn, the leno yarn being interwoven with each of the weft yarns at the junctions; and the junctions of the open mesh textile comprising at least one polymer component encapsulating and binding yarns at the junctions to strengthen the junctions.

15. The bonded composite open mesh textile of claim 14 wherein the junctions comprise at least four weft yarns interwoven with at least four warp yarns.

16. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

at least one leno yarn, the leno yarn forming a half-cross leno weave between adjacent weft yarns at the junctions; and the junctions of the bonded composite open mesh structural textile comprising at least one polymer component encapsulating and bonding yarns at the junctions to strengthen the junctions, the leno yarn being interwoven with each of the weft yarns at the junctions.

17. The bonded composite open mesh textile of claim 16 wherein the junctions comprise at least four weft yarns interwoven with at least four warp yarns.

18. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

the junctions of the open mesh textile comprising at least one leno yarn; and the junctions of the open mesh textile comprising at least one polymer component encapsulating and binding yarns at the junctions to strengthen the junctions, the polymer component being formed by a fusible polymer component of a fusible bonding yarn, a polymer impregnating the yarns or a polymer sheet or web.

19. The bonded composite open mesh textile of claim 18 wherein the junctions comprise at least four weft yarns interwoven with at least four warp yarns.

20. A bonded composite open mesh structural textile comprising:

a plurality of spaced-apart bundles of weft yarns;

a plurality of spaced-apart bundles of warp yarns, the warp yarn bundles intersecting with the weft yarn bundles at a plurality of junctions to define openings between adjacent weft and warp yarn bundles, the weft yarns and the warp yarns being interwoven at the junctions, each weft yarn being interwoven with the warp yarns independently of adjacent weft yarns, each warp yarn being interwoven with the weft yarns independently of adjacent warp yarns;

a portion of the warp and weft yarns comprising load bearing yarns, the load bearing yarns being high tenacity, high modulus, low elongation yarns;

the junctions of the open mesh textile comprising at least one leno yarn, the leno yarn being a fusible bonding yarn; and the junctions of the open mesh textile comprising at least one polymer component encapsulating and binding yarns at the junctions to strengthen the junctions.

21. The bonded composite open mesh textile of claim 20 wherein the junctions comprise at least four weft yarns interwoven with at least four warp yarns.

* * * * *